United States Patent [19]

Raz

[11] Patent Number: 4,519,656

[45] Date of Patent: May 28, 1985

[54] BATHROOM CABINET

[76] Inventor: Zeev Raz, 17 Keren Hayessod St., Beer-Sheva, Israel

[21] Appl. No.: 304,087

[22] Filed: Sep. 21, 1981

Related U.S. Application Data

[63] Continuation-in-part of Ser. No. 44,096, May 31, 1979, Pat. No. 4,307,923.

[30] Foreign Application Priority Data

| | | | |
|---|---|---|---|
| Sep. 10, 1980 | [IL] | Israel | 61043 |
| Feb. 17, 1981 | [ES] | Spain | 499.497 |
| May 5, 1981 | [IL] | Israel | 62787 |

[51] Int. Cl.[3] ..... A47B 91/16; A47B 97/00; E03D 1/00

[52] U.S. Cl. ..... 312/256; 4/353; 248/188.4; 248/188.9; 248/205.3; 312/209; 211/86

[58] Field of Search ..... 312/256, 255, 209, 237; 248/188.4, 188.9, 205.3; 4/661, 353, 363, 300.1; 211/86

[56] References Cited

U.S. PATENT DOCUMENTS

| | | | |
|---|---|---|---|
| 1,936,008 | 11/1933 | Cowan | 4/353 |
| 2,010,299 | 8/1935 | Gray | 248/188.4 |
| 2,099,932 | 4/1937 | Isaacson | 4/353 |
| 2,260,915 | 10/1941 | Mummery | 4/353 |
| 2,262,063 | 11/1941 | Swarr | 248/188.9 |
| 3,137,964 | 6/1964 | Maslow | 248/188.4 |
| 3,181,176 | 5/1965 | Nagy et al. | 4/353 |
| 3,476,257 | 11/1969 | O'Connell | 248/205.3 |
| 3,515,450 | 6/1970 | Jaecke | 312/209 |
| 4,307,923 | 12/1981 | Raz | 312/209 |

FOREIGN PATENT DOCUMENTS

| | | | |
|---|---|---|---|
| 834999 | 5/1960 | United Kingdom | 248/188.9 |

*Primary Examiner*—Alexander Grosz
*Attorney, Agent, or Firm*—Leonard Bloom

[57] ABSTRACT

The invention provides a cabinet, especially for storing and dispensing sanitary commodities, characterized in that the cabinet is provided with at least one compartment and at least one access door thereto and is further provided with attachment means depending from a bottom surface thereof for attachment of the cabinet atop a cover of a bathroom flush tank as an integral unit with the cover of said tank. The cabinet and cover are readily removable as a unit to allow access to a flushing mechanism within the flush tank in case of malfunction. The bottom surfaces of the attachment means are substantially planar and may be adjusted so as to be arranged non-parallel with the bottom of the cabinet rendering the cabinet compatibly attachable to bathroom flush tank covers of various sizes, configurations and curvatures. The invention also provides a kit for attaching such a cabinet to a cover of a bathroom flush tank. A method for alignably attaching such a cabinet to a flush tank cover is also described.

11 Claims, 8 Drawing Figures

BATHROOM CABINET

This application is a continuation-in-part of an application entitled Bathroom Cabinet, Ser. No. 044,096 filed May 31, 1979 now U.S. Pat. No. 4,307,923.

The present invention relates to bathroom cabinets. More particularly, the present invention relates to bathroom cabinets adapted for storing and dispensing sanitary commodities especially in the bathrooms of limited space and to preferred means and methods for attachment of said cabinets to bathroom flush tank covers.

The problem of providing an appropriate place to store sanitary commodities in a place which on the one hand is not readily accessible to children or readily visible to visitors to avoid embarrassment and on the other hand is readily accessible to the women of the household in close proximity to the bathroom toilet, where used sanitary commodities such as sanitary napkins, pads, tampons, etc. are often disposed, has to date not yet been satisfactorily solved.

The problem is even more acute in apartments constructed as in many countries wherein one bathroom is provided with a sink and a bath and/or shower and a second very small room is provided containing only a toilet. In said latter type room, very often, the toilet is situated under a window or vent placed above and behind the toilet and there is simply no place provided in said room where a cabinet can be affixed to a wall, since in such a room the only space not needed for headroom is that space above and behind the toilet, which space, as indicated, is unavailable for use because of the provision of an air-vent or window.

It is, therefore, an object of the present invention to solve said long outstanding problem and to provide a simple light-weight and inexpensive means enabling the convenient storage and dispensing of sanitary commodities in bathrooms in general and in bathrooms of limited space in particular.

In Israel Specification No. 54823, there is described and claimed a cabinet, especially for storing and dispensing sanitary commodities, characterized in that said cabinet is provided with at least one compartment and at least one latchable door to provide controlled and limited access thereto and is further provided with means for attachment of said cabinet atop a bathroom flush tank as an integral unit with the cover thereof, whereby said cabinet and cover are readily removable as a unit to allow access to a flushing mechanism within the flush tank in case of malfunction.

In said copending specification, however, the attachment means are described as being depending latches and/or flanges usually adapted to grip the flush tank cover to which they are to be attached. Some of said latches are of fixed position and, therefore, limit the attachment of a cabinet provided therewith to a flush tank cover of specific corresponding dimensions. Other preferred variably extendable depending gripping flanges described therein, while useful, add an appreciable manufacturing cost to the cabinets.

In Israel Specification No. 57429, there is described and claimed a cabinet, especially for storing and dispensing sanitary commodities, characterized in that said cabinet is provided with at least one compartment and at least one latchable door is further provided with means for attachment of said cabinet atop a bathroom flush tank as an integral unit with the cover thereof, whereby said cabinet and cover are readily removable as a unit to allow access to a flushing mechanism within the flush tank in case of malfunction, wherein said means for attachment comprise a cushion of yieldably pliable material attachable to the bottom of said cabinet and gluable to the top of said flush tank cover.

After further research and development, it has now been found that the desirable attributes achievable by the embodiments described in Israel Specification No. 57429 of rendering a cabinet compatible with bathroom flush tank covers of various sizes and configurations can be achieved by other means as well and, therefore, the present invention is directed to an expansion and modification of the concepts described in said earlier specification.

More particularly, the present invention provides a cabinet especially for storing and dispensing sanitary commodities, characterized in that said cabinet is provided with at least one compartment and at least one access door thereto and wherein said cabinet is further provided with attachment means depending from a bottom surface thereof for attachment of said cabinet atop a cover of a bathroom flush tank as an integral unit with said cover, whereby said cabinet and cover are readily removable as a unit to allow access to a flushing mechanism within the flush tank in case of malfunction and wherein bottom surfaces of said attachment means are adjustably displaceable relative planes parallel with the bottom of said cabinet rendering said cabinet compatibly attachable to bathroom flush tank covers of various sizes, configurations and curvatures. To accomplish this objective, and as disclosed herein, the attachment means has at least one bottom surface which is substantially planar and includes means for displacing the bottom surface so as to be non-parallel with respect to the bottom of the cabinet.

For lack of space, particularly where the bathroom is relatively small, it has been customary for users thereof to resort to the use of the flush tank cover or lid as a temporary storage spot or support surface for accessories and utilities such as comb and brush, whisk broom, scissors, containers of lotions and cosmetics and so on. As a matter of fact, it is likewise common practice to assist flush tank cover users by providing various forms of shelves and retaining guards such as are quite popular and are in widespread use. Plastic and rubber and equivalent trays, appropriate fence-like racks and so on are exemplary of the state of the art in use to prevent miscellaneous articles from being displaced from the top surface of the cover and falling into an uncovered bowl.

An improved version of such a tray is described in U.S. Pat. No. 3,181,176 which relates to an article retaining band for flush tanks and which claims in combination a toilet flush tank open at its top and provided with a readily applicable and removable lid, a band having a portion thereof snugly encircling a depending marginal edge portion of said lid, means for detachably applying and retaining said band in position on the lid, said band having a portion cooperating with an upper surface of the lid and transforming the same into an aritcle-confining and retaining tray.

As will be realized, however, said patent and similar patents relating to open trays or fence-like arrangements for the flush tank cover do not solve the aforementioned problem of storage of sanitary commodities and do not suggest or teach the presently proposed solution afforded by the cabinet of the present invention.

In the past, attempts have been made to design a cabinet to utilize the space above a toilet's flush tank for storage of general bathroom commodities, however, these previous attempts have suffered from one or more disadvantages. In some cases the previous constructions prevented or greatly hindered access to the flushing mechanism within the flush tank in case of malfunction. Also, certain of the previous cabinets were designed for use with only one particular form of flush tank thereby rendering them useless for use with other forms.

In recognition of these problems, U.S. Pat. No. 3,093,832 provided a cabinet which is self-supporting, by means of a plurality of legs, above the flush tank and provided with a pivotal access panel to enable access to the space between the cabinet and the flush tank and thereby to the interior of the tank and to the flushing mechanism therein in case of need.

As will be realized such a solution involving a complicated and expensive assembly of cabinet, legs, swinging panels, etc. while possibly useful for general storage purposes in bathrooms large enough to accommodate such an assembly does not satisfy the need for a simple, lightweight and inexpensive means for storing sanitary commodities in bathrooms of limited space.

Furthermore, as will be realized, cabinets which are self-supported by legs and/or which are adapted for attachment to a wall above the flush tank inherently face their purchaser with the equally disadvantageous choice of positioning at a comfortably accessible height which often will block easy access to the inwards of the flush tank or positioning high enough to give free access to the flush tank which high positioning is often too high for comfortable frequent use.

In U.S. Pat. Nos. 2,170,776, 1,861,802 and 2,099,923, there are described and claimed trays and cabinets having bottom surfaces adapted to be attached to the top of an open flush tank to form the cover thereof, however, said patents also do not solve the problem of providing a cabinet which can be attached to existing flush tank covers, of various sizes, configurations and curvatures, as found in a majority of homes today and involve the manufacture of specifically sized devices to fit specifically sized tanks and/or the wasteful removal of the cover already provided by the manufacturer and paid for by the consumer.

In contradistinction to said prior art cabinets and the problems inherent therein, as will be described more fully hereinafter in the preferred embodiments of the present invention, the cabinet is provided with attachment means depending from a bottom surface thereof for attachment of said cabinet atop a cover of a bathroom flush tank as an integral unit with said cover, whereby said cabinet and cover are readily removable as a unit to allow access to a flushing mechanism within the flush tank in case of malfunction and wherein bottom surfaces of said attachment means are adjustably displaceable relative planes parallel with the bottom of said cabinet rendering said cabinet compatibly attachable to bathroom flush tank covers of various sizes, configurations and curvatures.

Preferably, and as in embodiments described in Israel Specification 57429, the teachings of which are incorporated herein by reference, said attachment means are provided with adhesive bottoms to allow the adhesive attachment of said cabinets to said flush tank cover.

Preferably said attachment means will comprise leg means which leg means may be detachably attachable to the bottom of said cabinet and provided with cushions of yieldably pliable material attached to the bottom surfaces thereof and adhesively attachable to the top of said flush tank cover.

Alternatively, said leg means may be jointed to facilitate the displacement of bottom surfaces thereof relative planes parallel with the bottom of said cabinet. Especially preferred are leg means having a ball and socket joint to allow angular and rotational displacement of the bottom surface of each leg thereby maximizing the compatibility of a cabinet having a plurality of such legs to flush tank covers of the various curvatures available on the market today.

Preferably the cabinet will be made of lightweight plastic to further augment the ease of removal of the cabinet and the tank cover to which it is attached when necessary and will be sized so that its chosen depth will not substantially exceed the width of a flush tank cover.

As stated the preferred attachment means of the present invention have adhesive bottoms.

While arrangements using adhesive attachment of structures to carrier surfaces are known and have been found satisfactory as far as concerns the eventual strength of the adhesive joint and, thus, the immobility of the structure relative to the carrier surface, the very quality of today's adhesives (in the form, e.g., of self adhesive pads) has given rise to a new problem: Once the adhesive bottom surfaces of the structure have made contact with the carrier surface, the position of the structure on the carrier surface is determined and almost impossible to readjust, for instance, relative to another adjacent object, such as a wall. It was therefore necessary to orient, position and align these structures with respect to such adjacent objects and/or with respect to the edges of such carrier surfaces before the adhesive leg-bottom surfaces were permitted to make contact with the carrier surface, i.e., while the structure was manually held closely above, yet without touching, the carrier surface, an operation which the average user found difficult if not altogether impossible.

It is therefore a further object of the present invention to overcome the above difficulties and to provide a kit for attachment of said cabinets including auxiliary aligning and supporting means whereby, without need for manual support, the cabinets of the present invention with their preferred adhesive-coated legs, can be easily positioned and aligned on a flush tank cover and, such positioning and aligning operations having been completed, are rapidly and securely attached thereto.

Thus, the present invention further provides such a kit comprising a cabinet and an aligning and supporting means for facilitating the alignable attachment of said cabinets to a flush tank cover, said aligning and supporting means comprising a first portion at least temporarily attachable to said cabinet and at least one second portion dimensioned to extend beyond the adhesive bottom surfaces thereof in said attached position, said aligning and supporting means being sufficiently rigid to support said cabinet above said flush tank cover without said adhesive surfaces contacting said cover, and at least parts of said second portion of said aligning and supporting means being elastically deformable so that, upon application of pressure on said deformable supporting means, said adhesive bottom surfaces are allowed to make contact with said flush tank cover in order to adhere thereto.

The present invention also provides a method for alignably attaching a cabinet of the present invention having at least two legs to a bathroom flush tank cover surface, wherein said legs have adhesive bottom surfaces, said method comprising:

providing at least one elastically deformable supporting means to extend between said cabinet and said tank cover surface, which supporting means, in the non-deformed state thereof, extend beyond the adhesive surfaces of said legs;

aligning said cabinet on said flush tank cover surface while said cabinet is temporarily supported by said deformable supporting means; and applying pressure to said cabinet to deform said supporting means to allow said adhesive bottom surfaces of said legs to make contact with said flush tank cover surface in order to adhere thereto.

While the invention will now be described in connection with certain preferred embodiments with reference to the following illustrative figures so that it may be more fully understood, it is stressed that the particulars shown and described are by way of example and for purposes of illustrative discussion only and are presented in the cause of providing what is believed to be the most useful and readily understood description of the princples and conceptual aspects of the invention. In this respect no attempt is made to show structural details of the bathroom cabinet and kit and their constituent parts in more detail than is necessary for a fundamental understanding of the invention, the description taken with the drawings making apparent to those skilled in the art how the several forms of the invention may be embodied in practice.

Figure 1:
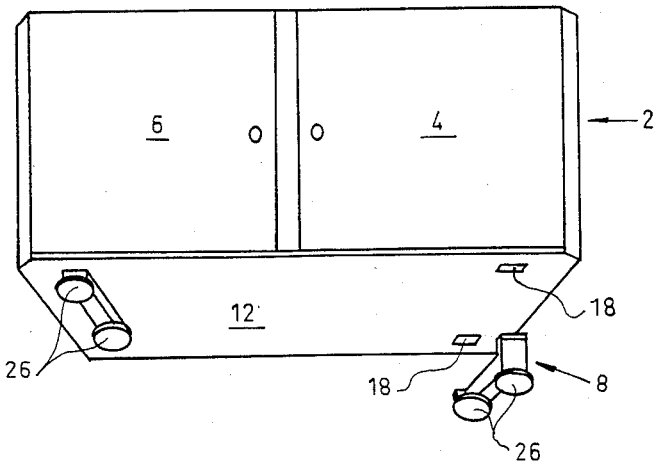
FIG. 1 is a perspective front bottom view of a cabinet provided with attachment means according to the present invention.
Figure 2:
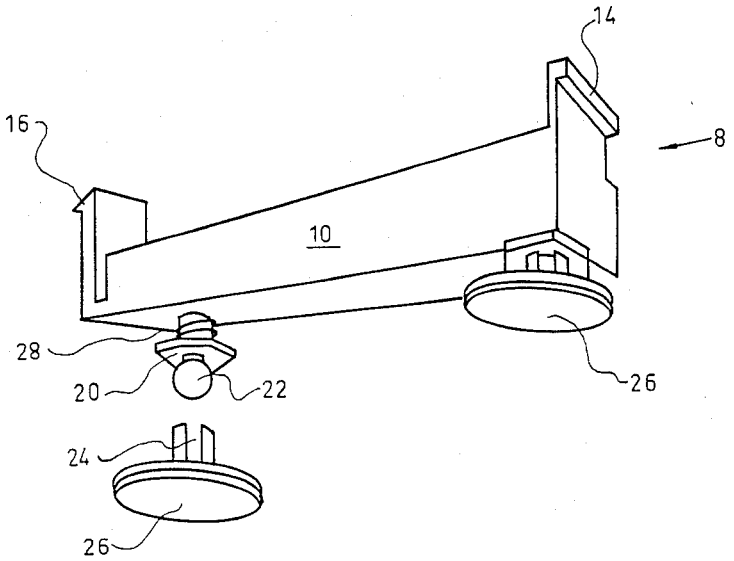
FIG. 2 is an enlarged partly exploded view of the attachment means of FIG. 1.

Referring to FIGS. 1 and 2, there is shown a cabinet 2 substantially parallelepipedal in shape having two doors 4, 6 and provided with attachment means 8 shown in greater detail in FIG. 2.

As will be seen, said attachment means 8 preferably comprise a first member 10 detachably attachable to the bottom surface 12 of said cabinet 2 by insertion of fixed 14 and springy arms 16 in the apertures 18 provided therefor in said bottom 12 of said cabinet 2. Said member 10 is provided with at least one protruding element 20, extending downwardly as shown from said first member 10 when attached to said bottom 12 of said cabinet, said element being provided with an interlocking ball 22 and a socket 24, forming a ball joint facilitating the displacement of a bottom surface 26 provided on said element relative planes parallel with the bottom of said cabinet by virtue of the multiplicity of angles and positions assumable by said bottom 26 of said element due to the movement around said joint.

Said attachment means are also preferably provided with interconnecting means such as the screw arrangement 28 shown, enabling the adjustment of the distance of protrusion of said element 20 from said member 10.

When it is desired to clean the cover of said tank, it is possible in the above embodiment to disengage the attachment means by flexing springy arm 16 out of aperture 18 or alternatively by disengaging each of the ball and socket joints 22–24 even though said adhesive means are sufficiently strong to assure that said cabinet and the cover to which it is attached are readily removable as a unit to allow access to a flushing mechanism within the flush tank in case of malfunction if desired.

As will be realized, the cabinets according to the present invention can be provided with different storage and dispensing possibilities. Thus, doors 4 and 6 can be swinging doors having an outwardly swinging shelf (not shown) respectively attached thereto and specifically sized to accommodate a plurality of sanitary tampons with their longitudinal axis in horizontal or vertical array or one of said doors can be a simple door providing access to a compartment which is sized to accommodate a plurality of aligned sanitary napkins.

As will be realized, the preferred attachment means shown and equivalents thereof render the cabinets of the present invention compatibly attachable to bathroom flush tank covers of various sizes, configurations and curvatures.

The bottoms 26 of elements 20 are provided with adhesive material which can be protected until attachment by means known per se and which adhesive means, while being preferred, result in the above described difficulties in properly aligning and positioning said cabinets prior to attaching them to the flush tank cover.

In order to better appreciate said problem and the solution thereof according to the present invention reference is now directed to FIGS. 3–8.

Figure 3:
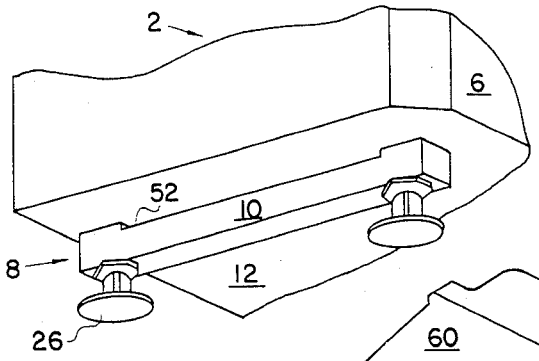
FIG. 3 is a partial perspective bottom view of a structure according to FIG. 1 having four tiltable, adjustable legs, each two mounted in a rail-like attachment means.

There is seen in FIG. 3 a partial, perspective bottom view of the cabinet according to FIG. 1, showing one of the two attachment means 8, including the member 10 and the adhesive bottoms 26. As seen more clearly now in this figure, there is provided a recess in the member 10 which, in conjunction with the bottom surface 12, forms a slot 52, the function of which will be evident from the description hereinafter.

Figure 4:
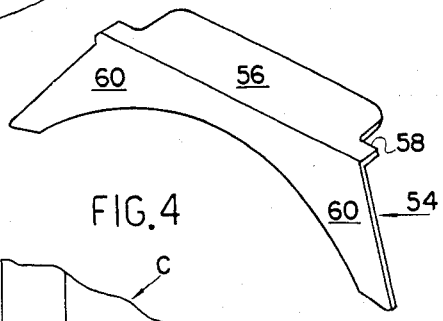
FIG. 4 is a perspective view of aligning and supporting means according to the invention for use in conjunction with the preferred attachment means of FIG. 2.

FIG. 4 shows a preferred embodiment of the aligning and supporting means 54 to be used for the adhesive mounting of the cabinet 2, which, as seen, comprises a first portion 56 which, up to an abutment 58, fits the slot 52 of FIG. 3. The second portion is in the form of a two-pronged fork with diverging prongs 60. These prongs lie in a plane which, as is best seen in FIG. 5, includes with the plane of the first portion 56 an angle larger than 90°.

Figure 5:
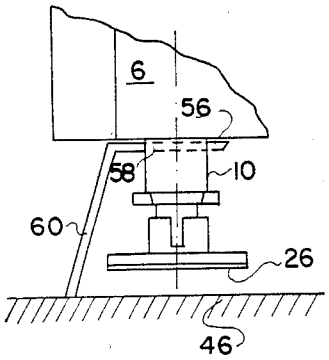
FIG. 5 is a partial front view of the structure of FIG. 3, seen to rest on the alignment means of FIG. 4, without the legs of the structure touching the flush tank cover surface, shown shaded.

The first stage of attaching the cabinet 2 to a flush tank cover surface 46 is illustrated in FIG. 5 which is a partial front view of the cabinet 2 of FIG. 3. The aligning and supporting means 54, of which, as stated above, there are two, one for each attachment means 8, are slipped into their respective slots 52 (FIG. 3) up to the abutment 58. The cabinet 2 with the alignment means 54 thus attached is now put onto the cover surface 46 where, being temporarily supported by the aligning means 54 above, yet quite near to, this surface 46, it is now easily aligned and positioned.

Figure 6:
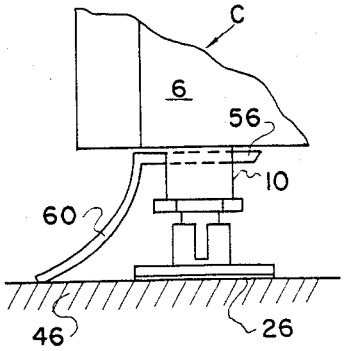
FIG. 6 is a similar front view, showing the structure after the application of a force, which has collapsed the aligning means and attached the structure to the tank cover surface.

Alignment having thus been accomplished, the next step, that is, final, adhesive attachment to the surface 46, is shown in FIG. 6, where it is clearly seen that pressure applied in direction of arrow C will flex, i.e., elastically deform, the prongs 60, thereby allowing the adhesive surfaces 26 to make contact with the surface 46 and to adhere thereto.

The cabinet 2 being now securely attached to the surface 46, the aligning and supporting means 54 can be removed from their slots 52.

Figure 7:
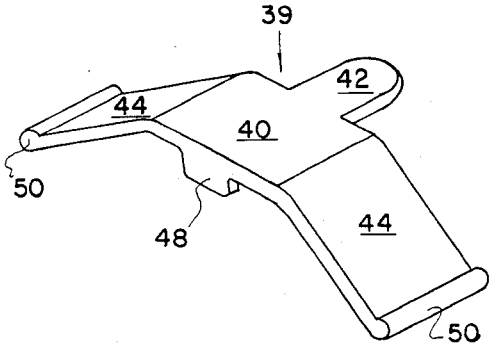
FIGS. 7 and 8 are perspective views of yet other embodiments of the aligning and supporting means according to the invention.
Figure 8:
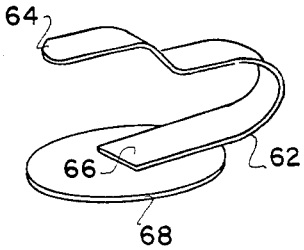

It will be realized that other auxilliary aligning and supporting means can also be used in the present invention such as those illustrated in FIGS. 7 and 8.

Thus, in FIG. 7 there is shown an aligning and supporting means 39, having a first portion 40, including a tang 42 which fits the slots 52 and, when introduced into the latter, keeps the entire part 39 in position relative to the attachment means 10 and the bottom 12. A second portion is in the form of two flat-spring-like wings 44, one on either side of the first portion 40 and integrally attached thereto. These wings 44, which are elastically deformable, the entire aligning means 39 being preferably made from a plastic material, slant outwards and downwards, as clearly seen in the drawing.

As with aligning means 54 of FIG. 4 the wings 44 of the aligning means 39 are dimensioned to extend beyond the adhesive bottom 26 of the attachment means 10 and, therefore, prevent the latter from making contact with the flush tank cover surface 46. Obviously, the aligning means 39 must be rigid enough to support the weight of the entire structure and to maintain a sufficient distance between the adhesive surface 26 and the cover surface 46. Being thus safely supported above, yet quite near to, the surface 46, the cabinet is now easily aligned and positioned, e.g., relative to a wall and/or to one or more edges of the tank cover surface 46 itself.

Alignment having been accomplished, the next stop is final attachment to the tank cover 46, in a manner analogous to that described with reference to FIG. 6.

Another even simpler aligning means could be of the type shown in FIG. 8 and comprises a flat spring 62 bent to a shape similar to that shown. The tip 64 could be introduced into a slot or catch similar to slot 52 of FIG. 3, and the other end 66 is advantageously fixed to a larger base plate 68 for greater stability. Alternatively tip 64 could be fitted with another base plate 68 (not shown), making it possible to use the aligning and supporting means without the need to provide a complementary slot such as slot 52. Other means for temporarily attaching the aligning and supporting means of the present invention to a bathroom cabinet to be supported, e.g., magnetic means, could also be utilized.

While not shown in the present Figures, but shown in said earlier specification, preferably at least one of the doors 4,6 is a swinging door having a shelf attached to the inner side thereof which shelf is provided with a guard wall to form an outwardly swingable compartment in the area defined by the inner side of said door, said shelf and said guard wall for retaining various sized items placed within said outwardly swingable compartment.

While the doors of the cabinet of the present invention have been described as swinging doors with or without attached compartment, it will be realized that said doors can also form part of a slidable door if desired.

It will therefore be evident to those skilled in the art that the invention is not limited to the details of the foregoing illustrative embodiments and that the present invention may be embodied in other specific forms without departing from the essential attributes thereof, and it is, therefore, desired that the present embodiments and description be considered in all respects as illustrative and not restrictive reference being made to the appended claims and all changes which come with the meaning and range of equivalency of the claims are, therefore, intended to be embraced therein.

What is claimed is:

1. A cabinet especially for storing and dispensing sanitary commodities, characterized in that said cabinet is provided with at least one compartment and at least one access door thereto and wherein said cabinet is further provided with attachment means depending from a bottom surface thereof for attachment of said cabinet atop a cover of a bathroom flush tank as an integral unit with said cover, whereby said cabinet and cover are readily removable as a unit to allow access to a flushing mechanism within the flush tank in case of malfunction, and wherein said attachment means has at least one bottom surface which is substantially planar and includes means for displacing said bottom surface so as to be non-parallel with respect to the bottom of said cabinet, thereby rendering said cabinet compatibly attachable to bathroom flush tank covers of various sizes, configurations and curvatures, wherein said attachment means comprise a first member detachably attachable to the bottom surface of said cabinet, said member being provided with at least one protruding element extending downwardly from said first member when attached to said bottom of said cabinet, said member and said element being provided with interconnecting means enabling the adjustment of the distance of protrusion of said element from said member.

2. A cabinet especially for storing and dispensing sanitary commodities, characterized in that said cabinet is provided with at least one compartment and at least one access door thereto and wherein said cabinet is further provided with attachment means depending from a bottom surface thereof for attachment of said cabinet atop a cover of a bathroom flush tank as an integral unit with said cover, whereby said cabinet and cover are readily removable as a unit to allow access to a flushing mechanism within the flush tank in case of malfunction, and wherein said attachment means has at least one bottom surface which is substantially planar and includes means for displacing said bottom surface so as to be non-parallel with respect to the bottom of said cabinet, thereby rendering said cabinet compatibly attachable to bathroom flush tank covers of various sizes, configurations and curvatures, wherein said attachment means comprise a first member detachably attachable to the bottom surface of said cabinet, said member being provided with at least one protruding element extending downwardly from said first member when attached to said bottom of said cabinet, said element being provided with a ball joint facilitating the displacement of said bottom surface.

3. A cabinet for storing and dispensing sanitary commodities, the cabinet being provided with at least one compartment; at least one access door giving access to the compartment; and an attachment means comprising a plurality of legs depending from the cabinet for attachment of the cabinet above a cover of a bathroom flush tank, to form a single unit with said cover; the cabinet and the cover being readily removable as a unit to allow access to a flushing mechanism within the flush tank; characterized in that each of the said plurality of legs depending from a bottom surface of the cabinet, each leg having at its lower end a respective element with a substantially downwardly facing substantially planar surface adapted to be attached to the upper surface of said cover, each said respective element being universally tiltably displaceable relative to said leg and relative to a plane parallel with the bottom of the cabinet, the cabinet thus being compatibly attachable to bathroom flush tank covers of various sizes, configurations and curvatures.

4. A cabinet as claimed in claim 3, wherein the said surface of each said element is provided with an adhesive layer.

5. A cabinet as claimed in claim 4, wherein each leg is detachably attachable to the bottom of the cabinet; and a respective cushion of pliable material is attached the said surface of the respective said element and is adhesively attachable to the top of the flush tank cover.

6. A cabinet as claimed in claim 3, wherein there is a joint located at a position between the upper end of each leg and the respective element to facilitate the said universal tiltable displacement of the said element.

7. A cabinet as claimed in claim 6, wherein the joint comprises a ball and socket joint.

8. A cabinet according to claim 6, wherein each said joint is located between the lower end of the leg and the said element.

9. A cabinet as claimed in claim 3, wherein an attachment member is provided which is detachably attachable to the bottom surface of the cabinet, at least one said leg extending downwardly from the attachment member when the member is attached to the bottom of the cabinet, the member and the leg being provided with an interconnecting means enabling adjustment of the distance of protrusion of the leg from the member.

10. A cabinet according to claim 3, wherein the cabinet is substantially parallelepipedal.

11. In a cabinet adapted to be supported on the top of a bathroom flush tank, the improvement in attaching means between the bottom of the cabinet and the cover of the flush tank, which comprises a first member, means for removably securing the first member to the bottom of the cabinet, a second member adhesively secured to the top of the flush tank cover, screw-operated means for adjusting the distance between the first and second members, and a universal joint between the first and second members, thereby facilitating the attachment of the cabinet to various flush tank covers.

* * * * *